US008117785B2

(12) United States Patent
Teichner et al.

(10) Patent No.: US 8,117,785 B2
(45) Date of Patent: Feb. 21, 2012

(54) GUTTER SYSTEM

(75) Inventors: Les Teichner, Chicago, IL (US); Jon Neely, Aurora, IL (US)

(73) Assignee: Quality Edge, Inc., Walker, MI (US)

( * ) Notice: Subject to any disclaimer, the term of this patent is extended or adjusted under 35 U.S.C. 154(b) by 661 days.

(21) Appl. No.: 10/550,404

(22) PCT Filed: Jul. 27, 2005

(86) PCT No.: PCT/US2005/026767
§ 371 (c)(1),
(2), (4) Date: Sep. 21, 2005

(87) PCT Pub. No.: WO2006/015109
PCT Pub. Date: Feb. 9, 2006

(65) Prior Publication Data

US 2007/0051051 A1 Mar. 8, 2007

Related U.S. Application Data

(60) Provisional application No. 60/591,546, filed on Jul. 27, 2004.

(51) Int. Cl.
*E04D 13/064* (2006.01)
*E04D 13/068* (2006.01)
*E04D 13/072* (2006.01)

(52) U.S. Cl. ..... 52/11; 52/12; 248/48.1; 248/48.2

(58) Field of Classification Search ..... 52/11, 12; 248/48.1, 48.2
See application file for complete search history.

(56) References Cited

U.S. PATENT DOCUMENTS

| | | | |
|---|---|---|---|
| 546,042 | A | 9/1895 | Van Horn |
| 603,611 | A | 5/1898 | Nye |
| 836,012 | A | 11/1906 | Cassens |
| 891,405 | A | 6/1908 | Cassens |
| 891,406 | A | 6/1908 | Cassens |
| 1,101,047 | A | 6/1914 | Yates |
| 2,144,663 | A | 1/1939 | Petersen |
| 2,209,741 | A | 7/1940 | Sullivan et al. |
| 2,271,081 | A | 1/1942 | Layton |
| 2,626,458 | A | 4/1953 | Harris |
| 2,669,950 | A | 2/1954 | Bartholomew |
| 2,672,832 | A | 3/1954 | Goetz |
| 2,873,700 | A | 2/1959 | Heier |
| 2,935,954 | A | 5/1960 | Matthews et al. |

(Continued)

FOREIGN PATENT DOCUMENTS

| | | | |
|---|---|---|---|
| GB | 2 219 018 | A | 11/1989 |

(Continued)

OTHER PUBLICATIONS

International Serach Report dated Oct. 24, 2006 for PCT application PCT/US05/26767.

*Primary Examiner* — Khoi Tran
*Assistant Examiner* — Jason Holloway
(74) *Attorney, Agent, or Firm* — Price Heneveld LLP

(57) ABSTRACT

A gutter system for preventing leaves and other debris from obstructing a gutter is provided, the gutter system including a bracket and a gutter cover. The bracket is removably coupled to a hanger and removably secured to the gutter cover.

20 Claims, 12 Drawing Sheets

U.S. PATENT DOCUMENTS 3,388,555 A 6/1968 Foster
3,420,378 A 1/1969 Turner
3,507,396 A 4/1970 Homa
3,550,381 A 12/1970 South
3,809,347 A 5/1974 Pekarek
3,826,048 A 7/1974 Merkin et al.
3,950,951 A 4/1976 Zukauskas
4,043,527 A 8/1977 Franzmeier
4,272,370 A 6/1981 Cunning
4,404,775 A 9/1983 Demartini
4,435,925 A 3/1984 Jefferys
4,493,588 A 1/1985 Duffy
D277,584 S 2/1985 Annestedt
4,497,146 A 2/1985 Demartini
4,553,356 A 11/1985 Pepper
4,616,450 A 10/1986 Shouse
4,632,342 A 12/1986 Skinner
4,757,649 A 7/1988 Vahldieck
4,796,390 A 1/1989 Demartini
4,910,926 A 3/1990 Paulsson
4,929,000 A 5/1990 Annestedt, Sr.
5,016,404 A 5/1991 Briggs
5,040,750 A 8/1991 Brant
5,072,551 A 12/1991 Manoogian, Jr.
5,181,350 A 1/1993 Meckstroth
5,189,849 A 3/1993 Collins
5,271,191 A 12/1993 Vahamaki
5,305,562 A 4/1994 Sapia
5,333,417 A 8/1994 Demartini
5,368,784 A 11/1994 Annestedt, Sr.
5,375,379 A 12/1994 Meckstroth
5,388,377 A 2/1995 Faulkner
5,398,464 A 3/1995 Jacobs
5,406,755 A 4/1995 Serano
5,457,916 A 10/1995 Tenute
5,459,965 A 10/1995 Meckstroth
5,468,026 A 11/1995 Annestedt
5,471,798 A 12/1995 Kuhns
5,491,998 A 2/1996 Hansen
5,495,694 A 3/1996 Kuhns
5,548,931 A 8/1996 Bryant
5,570,860 A * 11/1996 Schoenherr ..... 248/48.2
5,575,118 A 11/1996 Vahldieck
5,617,678 A * 4/1997 Morandin et al. ..... 52/11
5,638,643 A 6/1997 Demartini et al.
5,640,809 A 6/1997 Iannelli
5,640,810 A 6/1997 Pietersen
5,737,879 A 4/1998 Sweet
5,819,476 A * 10/1998 Annestedt, Sr. ..... 52/11
5,845,435 A * 12/1998 Knudson ..... 52/11
5,862,631 A 1/1999 Attaway et al.
5,878,533 A 3/1999 Swanfeld, Jr.
5,893,239 A 4/1999 Leahy
5,911,659 A 6/1999 Serano
6,016,631 A 1/2000 Lowrie, III
6,073,398 A 6/2000 Williams
6,098,344 A * 8/2000 Albracht ..... 52/12
6,098,345 A 8/2000 Demartini et al.
6,151,836 A 11/2000 McGlothlin et al.
6,151,837 A 11/2000 Ealer, Sr.
6,182,399 B1 2/2001 Pollera
6,260,307 B1 7/2001 Richardson
6,269,592 B1 8/2001 Rutter
6,367,743 B1 4/2002 Iannelli
6,412,228 B1 7/2002 Meckstroth
6,453,622 B1 9/2002 Walters
6,470,628 B1 10/2002 Walters
6,543,729 B1 4/2003 Ylonen
6,631,587 B2 10/2003 Lynch
6,658,796 B1 * 12/2003 Higgins ..... 52/11
6,681,527 B2 * 1/2004 Baker ..... 52/12
6,701,674 B1 * 3/2004 Albracht ..... 52/12
6,708,452 B1 3/2004 Tenute
6,732,477 B1 * 5/2004 Richard ..... 52/12
6,745,517 B2 6/2004 Vahldieck
6,931,792 B2 * 8/2005 McDonald et al. ..... 52/12
6,993,870 B2 * 2/2006 McDonald et al. ..... 52/11
6,993,871 B2 * 2/2006 Richard et al. ..... 52/11
7,104,012 B1 * 9/2006 Bayram ..... 52/12
2002/0069594 A1 6/2002 Sweet
2002/0073631 A1 * 6/2002 Baker ..... 52/12
2003/0009951 A1 1/2003 Bergeron
2003/0089046 A1 5/2003 Stevens
2004/0000098 A1 1/2004 Knudson
2004/0244303 A1 * 12/2004 Seise, Jr. ..... 52/12
2004/0244304 A1 12/2004 Bullinger
2005/0082436 A1 * 4/2005 Snell ..... 248/48.2

FOREIGN PATENT DOCUMENTS

JP 2-304168 12/1990
JP 3-28448 2/1991
JP 3-100254 4/1991
JP 3-267449 11/1991
JP 5-52009 3/1993
JP 5-106316 4/1993
JP 5-222812 8/1993
JP 6-57894 3/1994
JP 6-93692 4/1994
JP 6-146508 5/1994
JP 6-193219 7/1994
JP 6-235249 8/1994

* cited by examiner

GUTTER SYSTEM

CROSS REFERENCE

This application claims the priority of International Application No. PCT/US05/26767, filed on Jul. 27, 2005, which claims the priority of U.S. Provisional Patent Application No. 60/591,546, filed Jul. 27, 2004, the terms of which are incorporated herein by reference.

BACKGROUND OF THE INVENTION

This invention relates generally to gutter systems, and more particularly, to gutter systems for preventing debris from entering the gutter system.

Many gutter systems have been developed to prevent debris, such as leaves, twigs and paper, from obstructing or clogging the flow of water through the gutters to downspouts that distribute the runoff water away from structures, such as homes, office buildings, etc. For example, gutter screens that act to filter out debris without restricting the flow of water into the gutter have been developed and are commonly known. While these systems have been somewhat successful in preventing debris from entering gutters, a continual need exists for developing novel approaches for providing better solutions to this problem for homeowners.

SUMMARY OF THE INVENTION

A gutter system for preventing leaves and other debris from obstructing a gutter is provided. The gutter system includes a bracket and a gutter cover, the bracket being removably coupled to a hanger and removably secured to the gutter cover. An alternative embodiment of this invention is also provided where the bracket and hanger form an integrated structure or integrated bracket. Yet a further embodiment of the present invention is described, which includes an extension member for allowing integrated brackets to fit gutters of varying depths.

A better understanding of the objects, advantages, features, properties and relationships of the invention will be obtained from the following detailed description and accompanying drawings which set forth illustrative embodiments that are indicative of the various ways in which the principles of the invention may be employed.

BRIEF DESCRIPTION OF THE DRAWINGS

For a better understanding of the invention, reference may be had to preferred embodiments shown in the following drawings in which.

DETAILED DESCRIPTION

Figure 1:
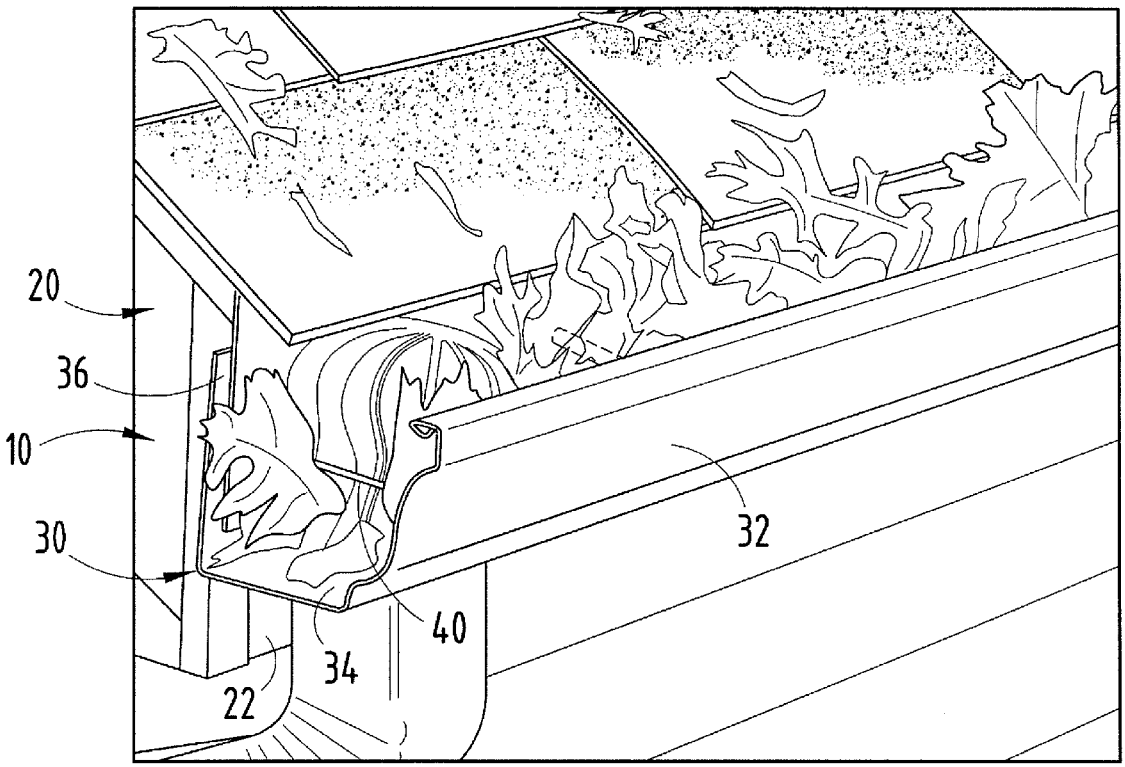
FIG. 1 PRIOR ART
FIG. 1 illustrates a perspective view of a prior art gutter system, which is attached to a structure.

Turning now to the figures, wherein like reference numerals refer to like elements, there is illustrated a gutter system 10, which is attached to a structure 20. As particularly illustrated in FIGS. 2 through 38, the gutter system 10 is generally comprised of a gutter 30, a hanger 40 and a gutter cover 50.

As shown in FIG. 1, for attaching prior art gutter systems to a structure, a hanger 40 is positioned transverse to the gutter 30 and a nail, screw or other attachment means is inserted through gutter 30, hanger 40 and facia 22 of structure 20. The combination of the attachment means, hanger 40 and facia or fascia 22 also act to strengthen the structural integrity of the gutter 30. Gutters 30 generally consist of a front wall 32, a bottom wall 34 and a rear wall 36, where the rear wall interfaces with the facia 22 of structure 20.

Figure 2:
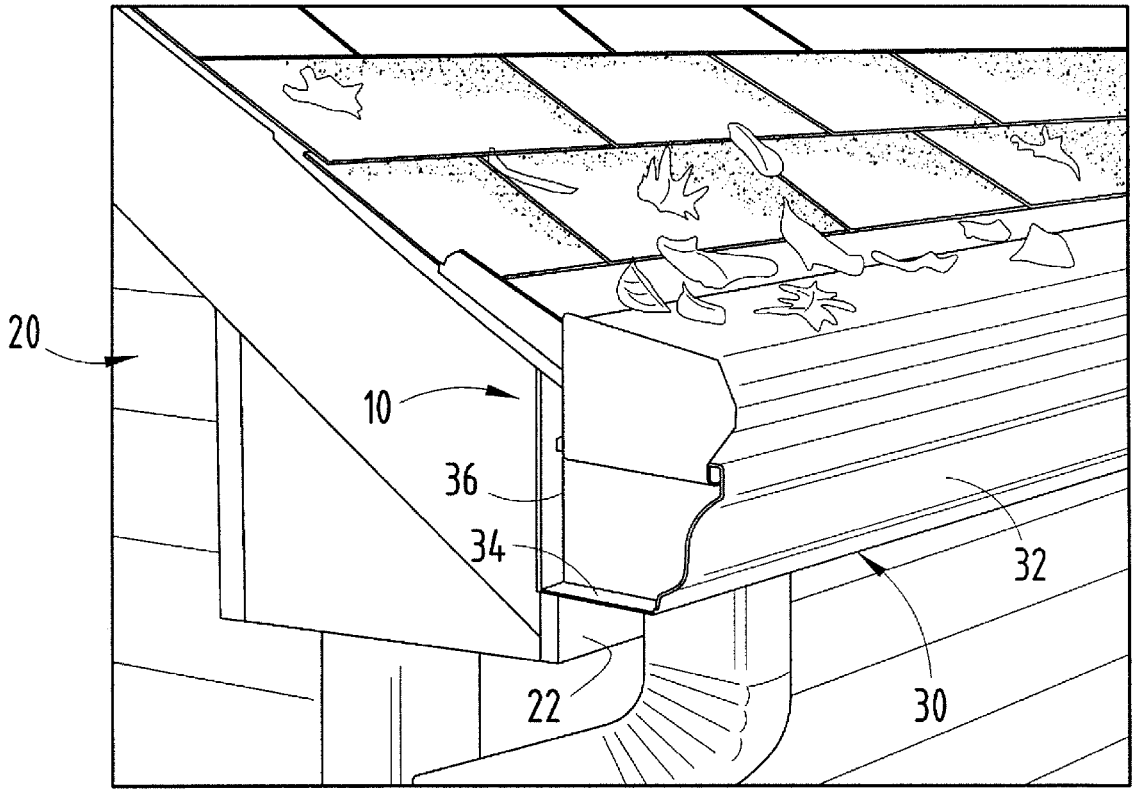
FIG. 2 illustrates a perspective view of a gutter system employing a gutter cover.

To prevent debris, such as leaves, twigs and paper from entering and being lodged within gutter 30, a gutter cover 50 may be provided. As shown in FIG. 2, the gutter cover may include a lip section 52, a middle section 54 and a back section 56. It should be understood by those with skill in the art that the gutter cover 50 blocks substantially all of gutter opening 38. Runoff water from structure 20 is slowed by gutter cover 50 in order to allow surface tension of the water as it flows over the gutter cover 50 to cause the water to adhere to the lip section 52 and be redirected into gutter 30 without allowing debris to enter gutter 30. For slowing the flow of runoff water from the structure and facilitating the surface tension effect of the water, a protrusion 54*a*, as shown in FIGS. 3 through 7, may be provided that extends along the entire width of gutter cover 50 in a direction that is substantially parallel to gutter 30. Protrusion 54*a* is preferably located on the middle section 54, but may also be located at different points on the gutter cover 50 as well. The middle section 54 of gutter cover 50 also includes a fold 58, which will be discussed in detail below.

Figure 3:
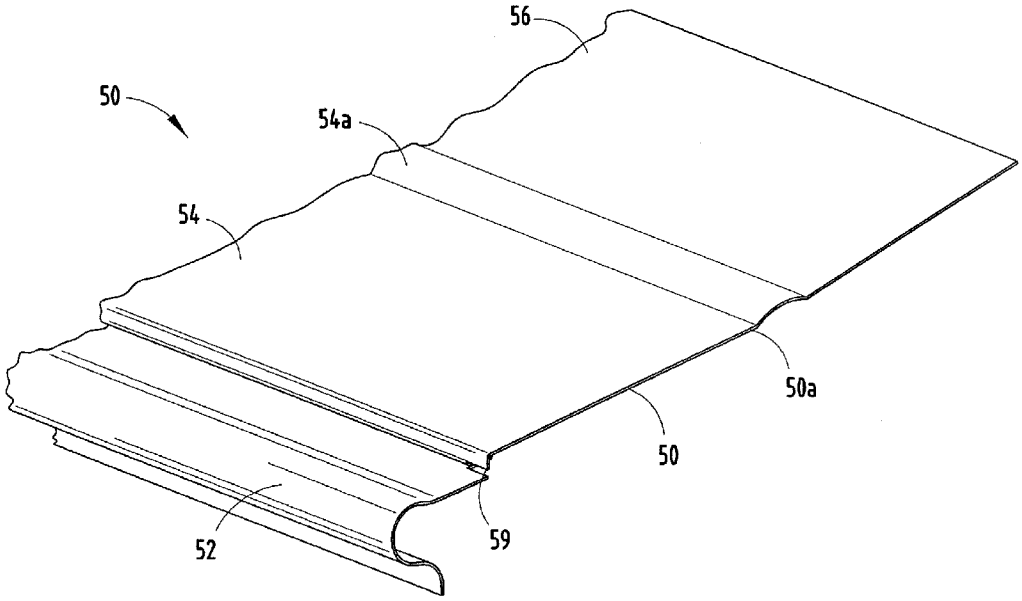
FIG. 3 illustrates a perspective view of a gutter cover.
Figure 8:
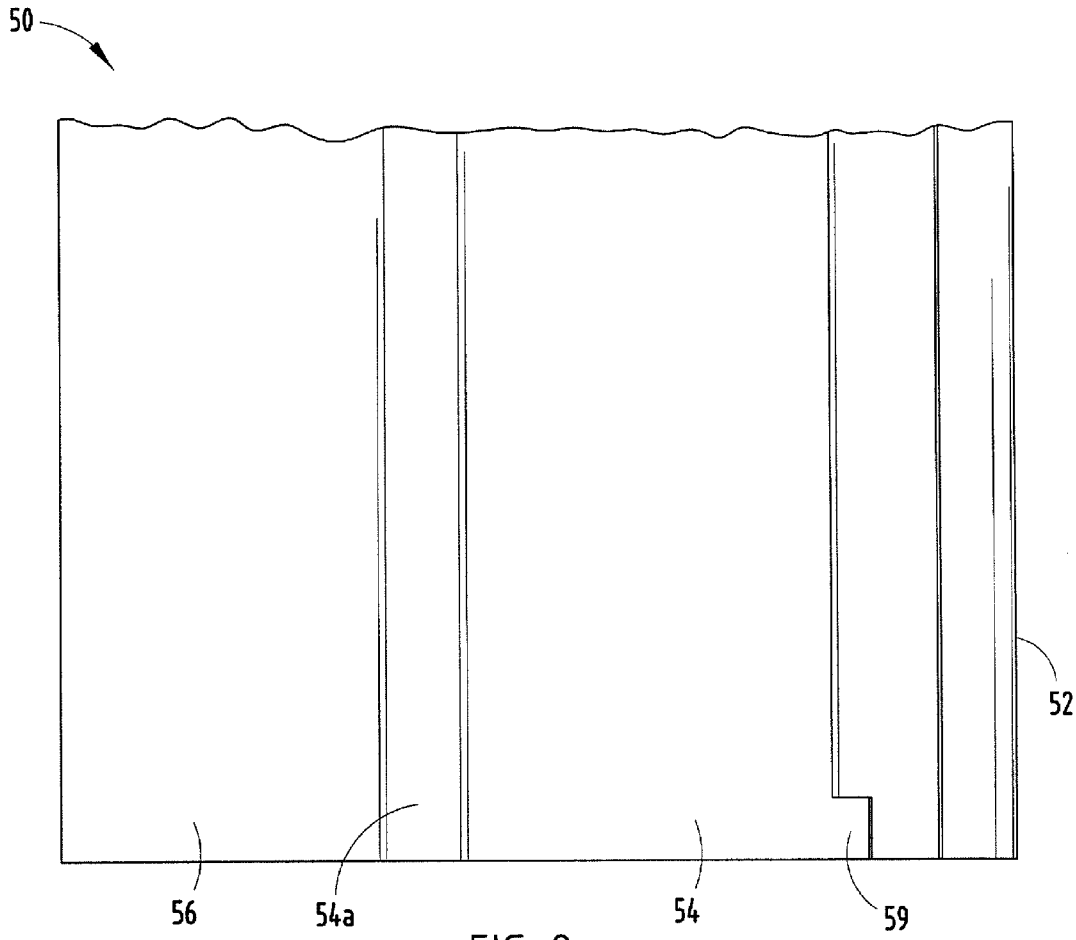
FIG. 8 illustrates a top view of a sheet of material prior to its being formed into a gutter cover.

As gutter covers 50 generally come in five or ten foot sections, most structures will require several sections of gutter covers 50 to accommodate each side of the structure 20. To prevent leakage at the seams that adjoin the respective gutter covers 50, a notch 59 may be provided on each gutter cover 50 during its manufacture similar to the notch 59 on the unformed gutter cover 60 shown in FIG. 8. Further, once the unformed gutter cover 60 is shaped into a completed gutter cover 50, as depicted in FIG. 3, the notch 59 becomes covered by fold 58. Notch 59 allows two gutter covers 50 to be removably coupled to one another by positioning a portion of one gutter cover 50 within the area created by notch 59 in the other gutter cover 50. In this manner, a small portion of the second gutter cover 50 will overlap a small portion of the first gutter cover 50, thus preventing leakage. Although the shape of notch 59 shown in FIG. 8 is generally rectangular, it should be understood that other shapes may also be employed, as long as one gutter cover 50 is able to be fitted within an adjoining gutter cover 50 to create an aesthetically pleasing seal or joint between the two gutter covers. While gutter cover 50 is preferably comprised of aluminum, gutter cover 50 may also be made of other metals, vinyl materials, plastic or any other material which is light-weight, inexpensive and capable of acting as a rigid support member.

To provide structural support to gutter 30 and gutter cover 50, a bracket 100 may be provided. FIGS. 9 through 12 depict a first embodiment of bracket 100. Bracket 100 may be further comprised of pins 102, a base member 104, a front member 106, a rear member 108 and an intermediate member 110. For attaching bracket 100 to prior art hangers 40, such as the hanger 40 shown in FIG. 1, pins 102 may be designed to correspond to apertures 42 (not shown) that are formed within standard hangers 40. While pins 102 are designed to be snap-fit within apertures 42, it should be appreciated that there are other ways in which the bracket 100 may be removably secured to hanger 40 and the description herein with respect to pins 102 should not be viewed as limiting the scope of this application. For example, screws or other fastening means may also be used.

For strengthening the structural integrity of the bracket 100, a central wall portion 122 that fills in the area between the front member 106, intermediate member 110, rear member 108 and the base member 104 may also be provided. The central wall portion 122 may also include a plurality of apertures for allowing objects to extend transversely through the bracket 100 or to be attached to the bracket 100. For example, a first aperture 124 may be provided to receive a heating member, such as a wire or coil, that may be run perpendicularly to the bracket 100 to counteract gutters being blocked by ice or snow. In addition, a second aperture (not shown) may be provided to receive an attachment means, such as straps. The strap may be used to connect the bracket 100 to the structure by fastening one end of the strap to the structure 20 and tying the other end to the second aperture of the bracket 100.

Figure 9:
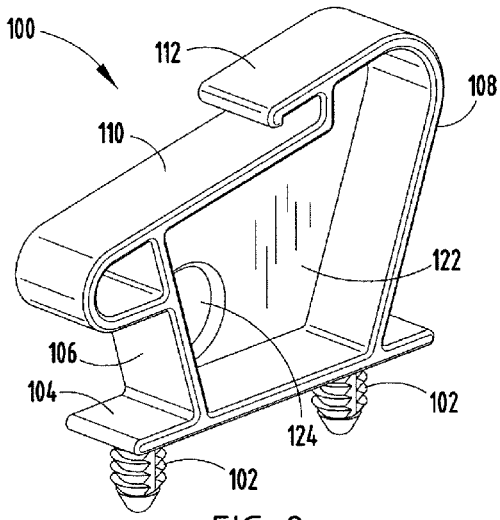
FIG. 9 illustrates a perspective view of a first embodiment of a gutter bracket.

As shown in FIG. 9, front member 106 is formed to match the geometry of the lip section 52 of gutter cover 50. This provides structural support for gutter cover 50 and prevents the collapse of gutter cover 50 within the opening 38 of gutter 30, as a result of heavy loading by snow or other debris. To provide additional structural support for gutter cover 50, intermediate member 110 may also be configured to mirror the geometry of the gutter cover 50. Bracket 100 may also be removably coupled to gutter cover 50 by inserting coupling member 112, which acts as a male member, into the area formed by fold 58, which acts as the female member.

Figure 4:
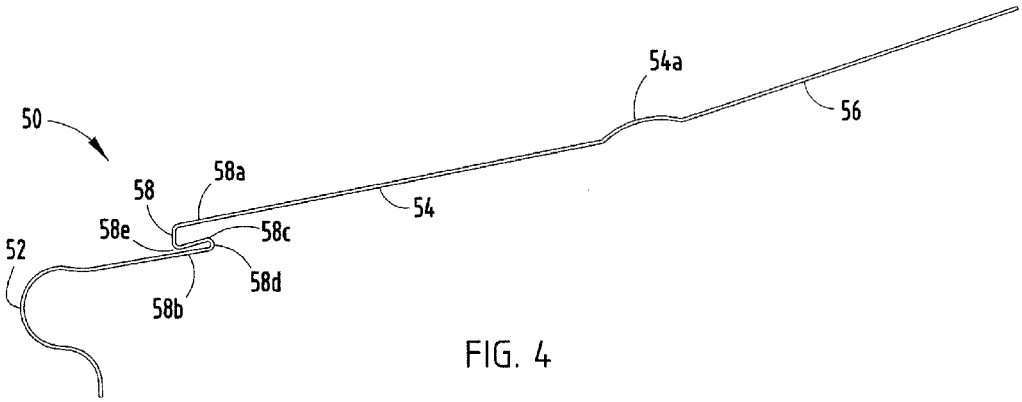
FIG. 4 illustrates a side view of the gutter cover shown in FIG. 3.
Figure 5:
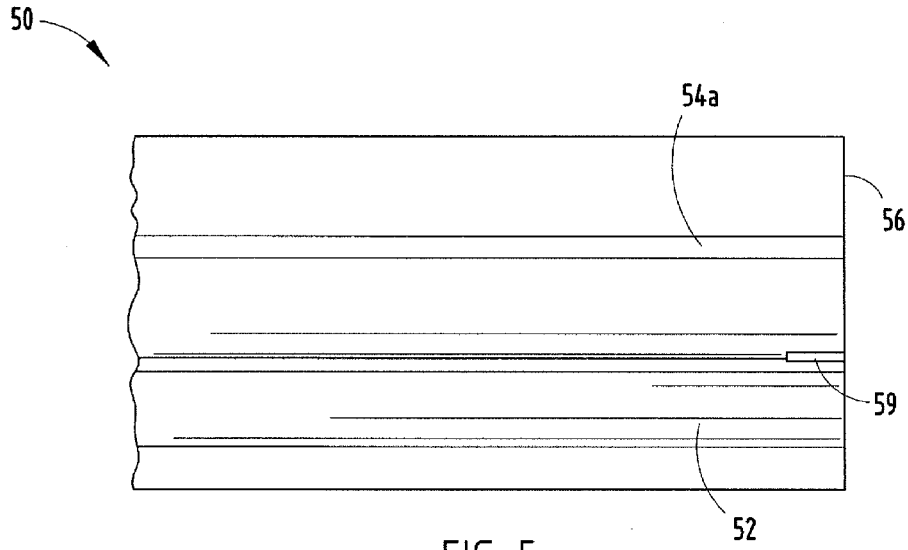
FIG. 5 illustrates a front view of the gutter cover shown in FIG. 3.
Figure 6:
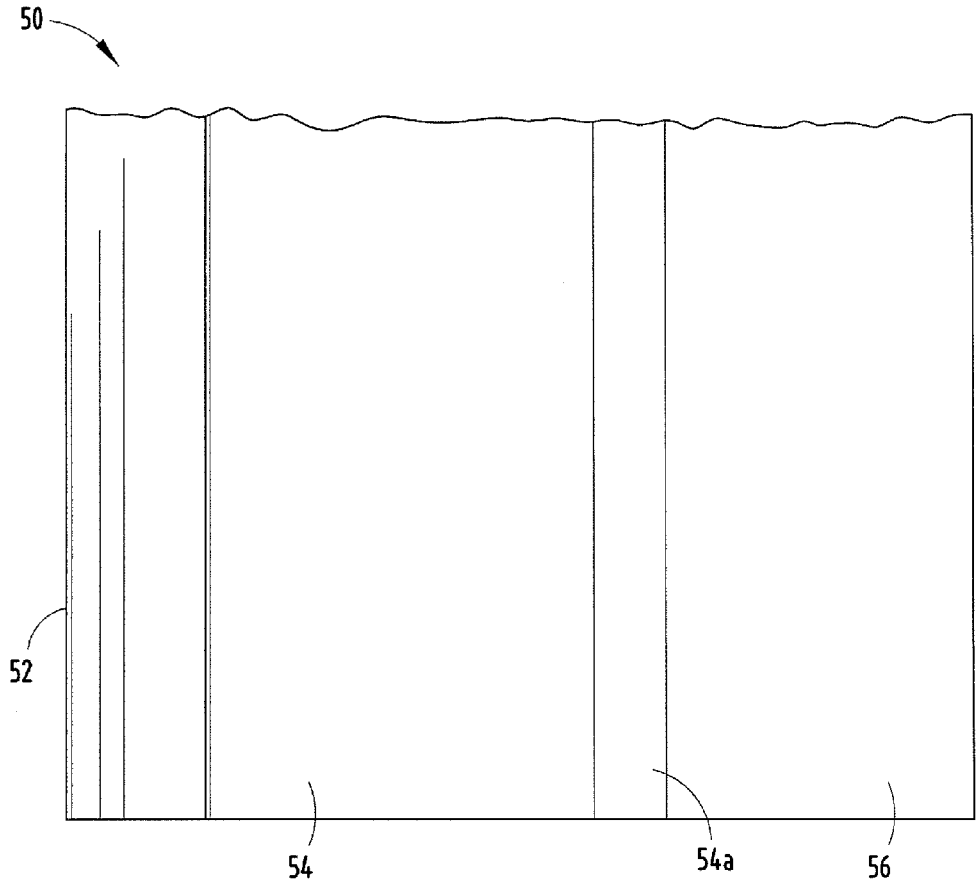
FIG. 6 illustrates a top view of the gutter cover shown in FIG. 3.
Figure 7:
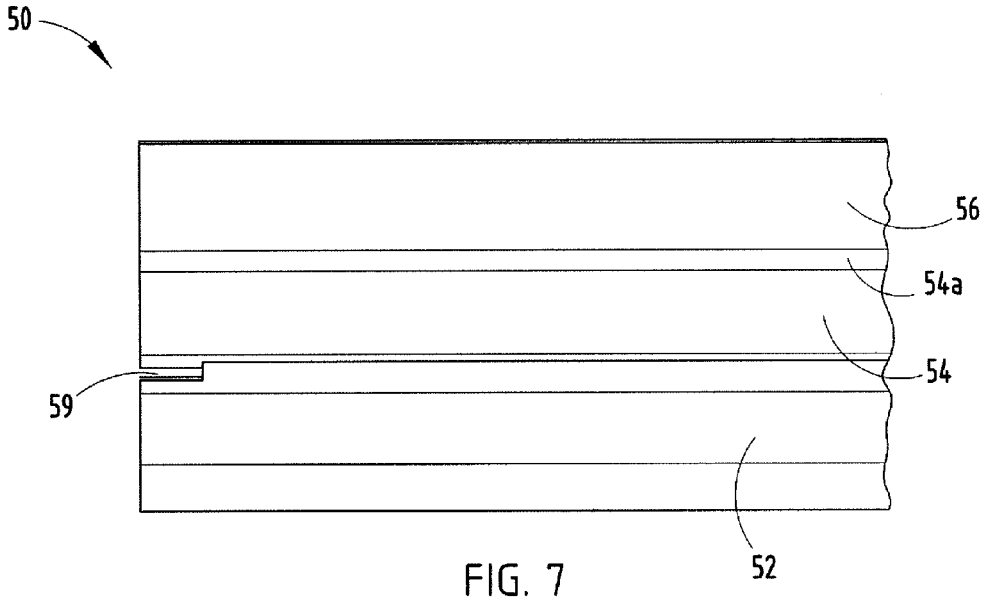
FIG. 7 illustrates a rear view of the gutter cover shown in FIG. 3.
Figure 10:
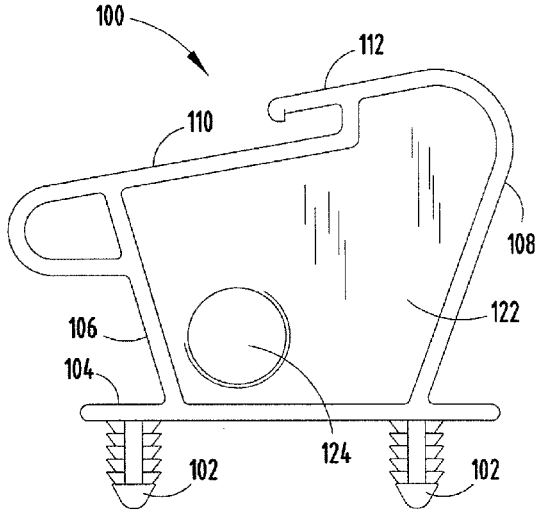
FIG. 10 illustrates a side view of the gutter bracket shown in FIG. 9.
Figure 10A:
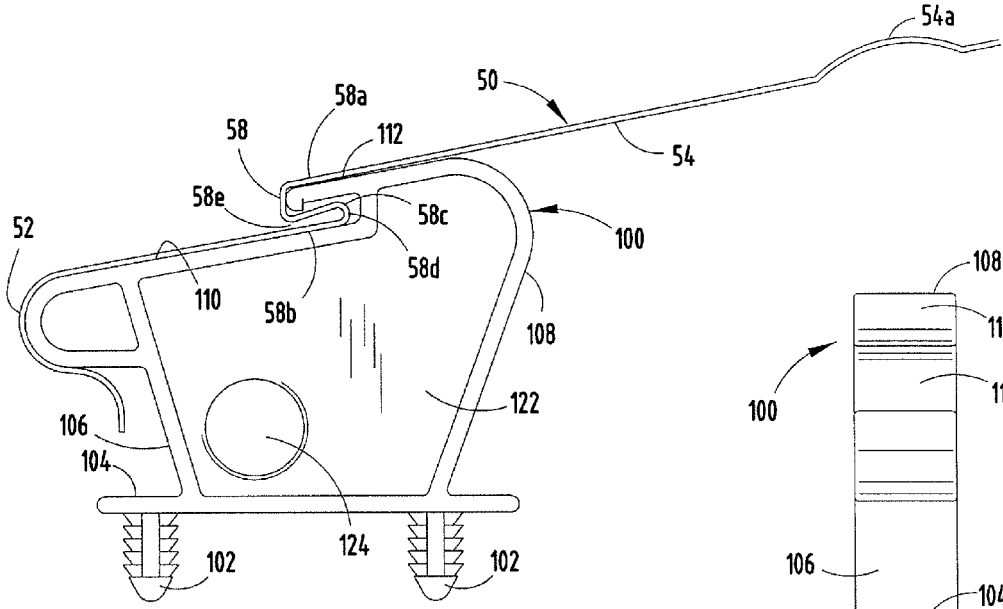
FIG. 10A illustrates a side view of the gutter cover shown in FIG. 3 assembled on the gutter bracket shown in FIG. 10.
Figure 11:
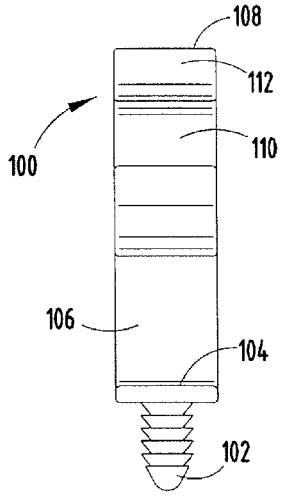
FIG. 11 illustrates a front view of the gutter bracket shown in FIG. 9.
Figure 12:
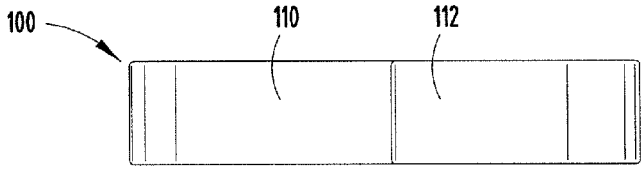
FIG. 12 illustrates a top view of the gutter bracket shown in FIG. 9.

More specifically, as best shown in FIG. 4, the fold 58 on gutter cover 50 has a generally U-shaped side elevational shape with generally parallel, opposite wall portions 58*a* and 59*b* that are vertically spaced apart and are inclined upwardly at a predetermined angle to define the female coupling member 58 into which the male coupling member 112 on bracket 100 is received and retained, as shown in FIG. 10A. The lower wall portion 58*b* of fold 58 is created by a reverse bend or doubled over portion 58*c* that has a closed rearward end 58*d* that protrudes rearwardly and upwardly towards the back section 56 of gutter cover 50 at the predetermined angle of fold 58, and a necked forward end 58*e* that extends forwardly and downwardly towards the lip section 52 of gutter cover 50 at the predetermined angle of fold 58. The male coupling member 112 on bracket 100 is in the form of a projection that protrudes forwardly and downwardly toward the front member 106 of bracket 100 at the same angle as female coupling member 58. The projection on the male coupling member 112 is closely received and retained in the U-shaped female coupling member 58 to securely mount gutter cover 50 on mounting bracket 100, without the need for separate fasteners.

In addition to increasing the structural support for gutter cover 50, coupling member 112 also acts to prevent upward force on the gutter cover 50 from peeling the gutter cover 50 back and thereby potentially allowing debris to enter the gutter system 10, and to form an integrated gutter system 10 that links gutter 30, gutter covers 50, brackets 100 and facia 22 together. Moreover, this is accomplished without requiring screws or other fasteners to attach gutter cover 50 to bracket 100, which avoids requiring unnecessary holes to accommodate such fasteners and potential leakages caused by such holes. Bracket 100 may be formed by using standard injection molding techniques. While the bracket 100 is preferably comprised of injection molded plastic, bracket 100 may also be made of other metals, vinyl materials, plastic or any other material that is light-weight, inexpensive and capable of acting as a rigid support member. Bracket 100 may also assume varying shapes and thicknesses depending on the environment with which it is being used without departing from the scope of this invention.

Coupling member 112 also facilitates the installation of gutter cover 50 by establishing a set distance between the lip section 52 of gutter cover 50 and the front wall 32 of gutter 30. This is possible because the distance between the lip section 52 of gutter cover 50 and fold 58 is a predetermined distance and because the location of the apertures 42 on hanger 40 within which bracket 100 may be placed is also predetermined. Hence, by coupling bracket 100 to hanger 40 and coupling member 112 of bracket 100 to gutter cover 50, lip section 52 of gutter cover 50 will always be positioned in substantially the same position and distance with respect to the front wall 32 of gutter 30. This can also be achieved with other embodiments of bracket 100, discussed below, since such embodiments would also provide a fixed position for coupling member 112 in relation to the front wall 32 of gutter 30. Although the foregoing embodiment of the present invention preferably includes a coupling member 112 for attaching bracket 100 to cover 50, it should be understood by those with skill in the art that bracket 100 may also be attached to cover 50 by other means, such as fasteners, snap fittings or similar means.

FIGS. 13 through 17 depict a second embodiment of bracket 200, which is designed to operate independently and without any interaction with hangers or similar means. More specifically, bracket 200 generally includes base member 204, a front member 206, a rear member 208 and intermediate member 210 and acts to integrate the functionality provided by bracket 100 and hanger 40 (discussed above). For supporting the bracket within the gutter 30, base member 204 also includes a lower support member 220 and an upper support member 216. The lower support member 220 is designed to be positioned flush against rear wall 36 and the upper support member 216 is designed to be removably coupled to gutter 30. Intermediate support member 218 may also be included to increase the structural support of bracket 200. The combination of the upper support member 216, the base member 204 and the rear support member 220 act to replace prior art hangers 40 and to provide improved structural support for gutter 30. For strengthening the structural integrity of the bracket 200, a central wall portion 222 that fills in the area between the front member 206, intermediate member 210, rear member 208 and the base member 204 may also be provided. The central wall portion 222 may also include a plurality of apertures for allowing objects to extend transversely through the bracket 200 or to be attached to the bracket 200. For example, a first aperture 224 may be provided to receive a heating member, such as a wire or coil, that may be run perpendicularly to the bracket 200 to counteract gutters being blocked by ice or snow. In addition, a second aperture 226 may be provided to receive an attachment means, such as straps. The strap may be used to connect the bracket 200 to the structure by fastening one end of the strap to the structure 20 and tying the other end to the second aperture 226 of the bracket 200.

Figure 13:
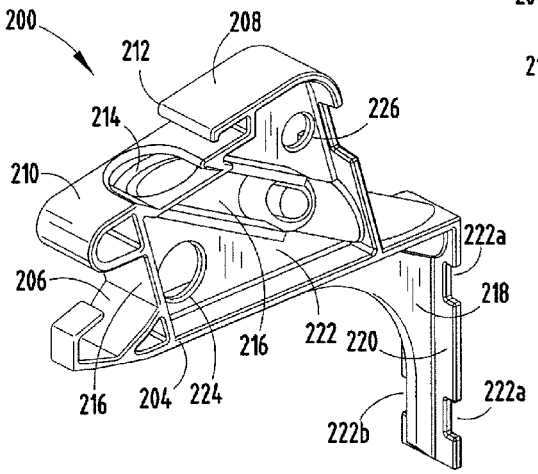
FIG. 13 illustrates a perspective view of a second embodiment of a gutter bracket.
Figure 14:
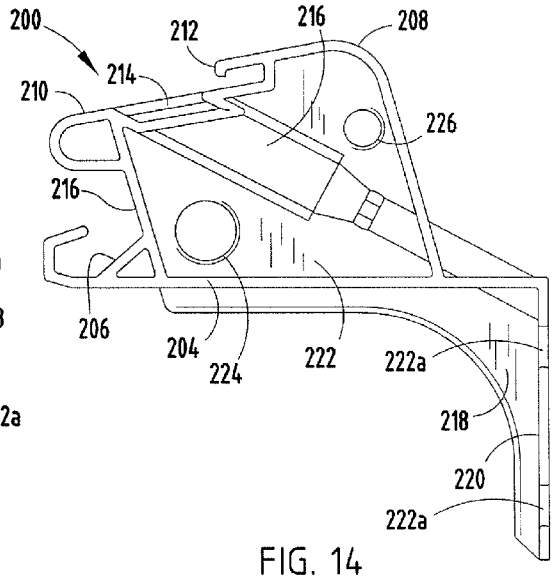
FIG. 14 illustrates a side view of the gutter bracket shown in FIG. 13.
Figure 15:
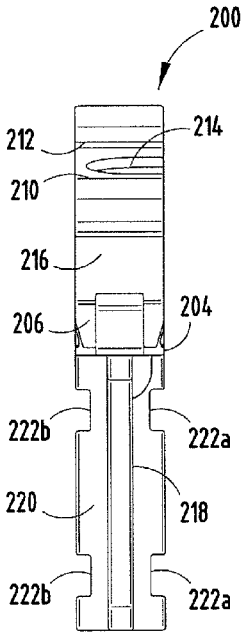
FIG. 15 illustrates a front view of the gutter bracket shown in FIG. 13.
Figure 16:
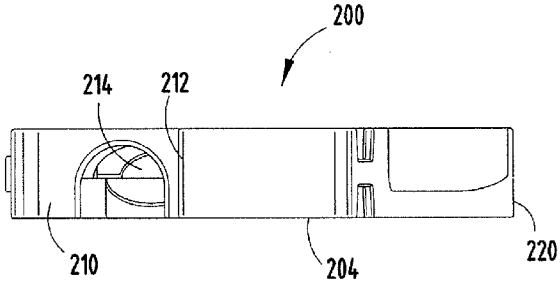
FIG. 16 illustrates a top view of the gutter bracket shown in FIG. 13.

As shown in FIGS. 9 and 13, front and rear members 206, 208 and coupling member 212 operate similar to front and rear members 106, 108 and coupling member 112, which are described in connection with the first embodiment above. FIG. 13 also shows a diagonal bore 214 for receiving a nail (not shown) for securing bracket 200 to the facia 22 of structure 20. Although the diagonal bore 214 is preferably located in intermediate member 210 and extends to lower support member 220, it should be appreciated that the diagonal bore 214 may be located differently and still achieve its intended purpose. It should also be appreciated that nail may also be replaced by a screw or similar fastening means for securing the bracket 200 and gutter 30 to structure 20. Bracket 200 may be formed by using standard injection molding techniques. While bracket 200 is preferably comprised of injection molded plastic, bracket 200 may also be made of other metals, vinyl materials, plastic or any other material which is light-weight, inexpensive and capable of acting as a rigid support member. Bracket 200 may also assume varying shapes and thicknesses depending on the environment with which it is being used without departing from the scope of this invention.

Since gutters 30 are available in different standard sizes (i.e., with different depths), an extension member 300 may be provided. To allow extension member 300 to be connected to lower support member 220, extension member 300 may be designed to mirror the outer periphery of lower support member 220 of bracket 200, as shown in FIGS. 18 through 22. While it is preferred that extension member 300 is approximately one inch deep, extension member 300 may assume varying depths to accommodate differently sized gutters.

Figure 17:
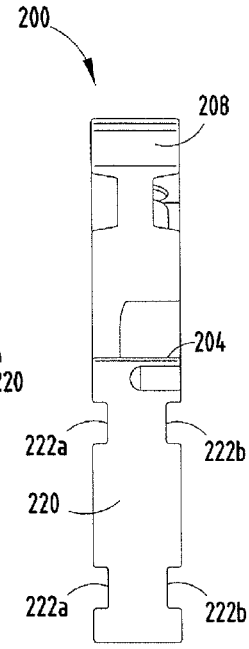
FIG. 17 illustrates a rear view of the gutter bracket shown in FIG. 13.
Figure 18:
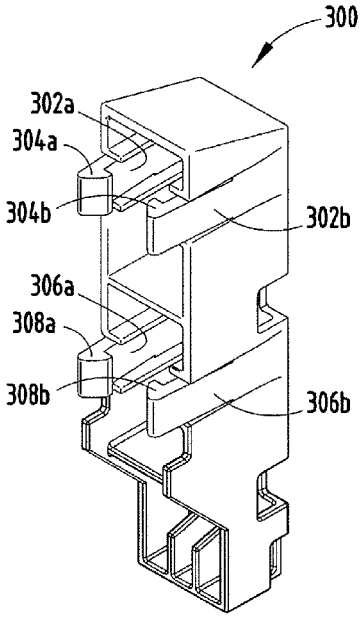
FIG. 18 illustrates a perspective view of an extension member capable of being coupled to the gutter bracket shown in FIG. 13.
Figure 19:
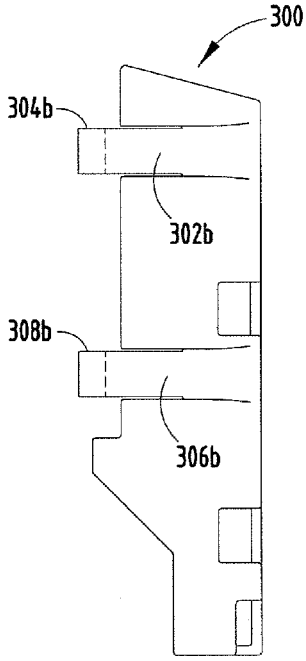
FIG. 19 illustrates a side view of the extension member shown in FIG. 18.
Figure 20:
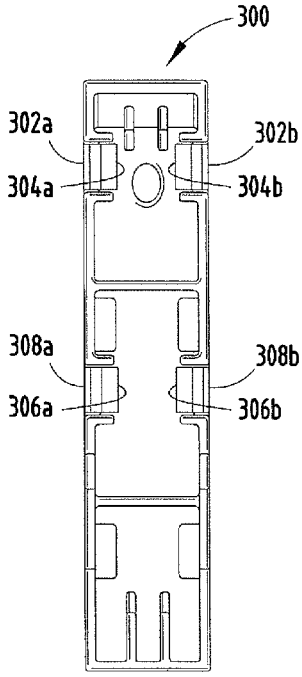
FIG. 20 illustrates a front view of the extension member shown in FIG. 18.
Figure 21:
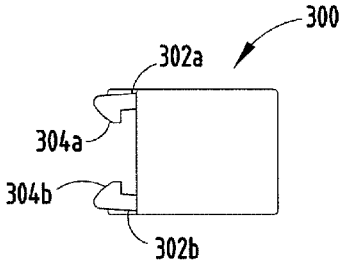
FIG. 21 illustrates a top view of the extension member shown in FIG. 18.
Figure 22:
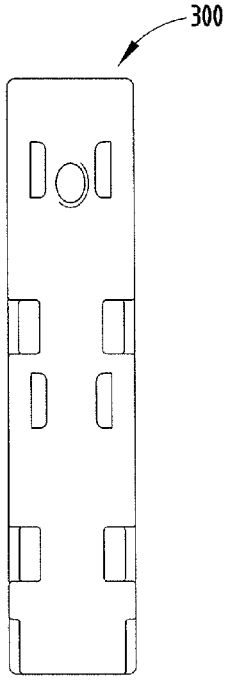
FIG. 22 illustrates a rear view of the extension member shown in FIG. 18.
Figure 23:
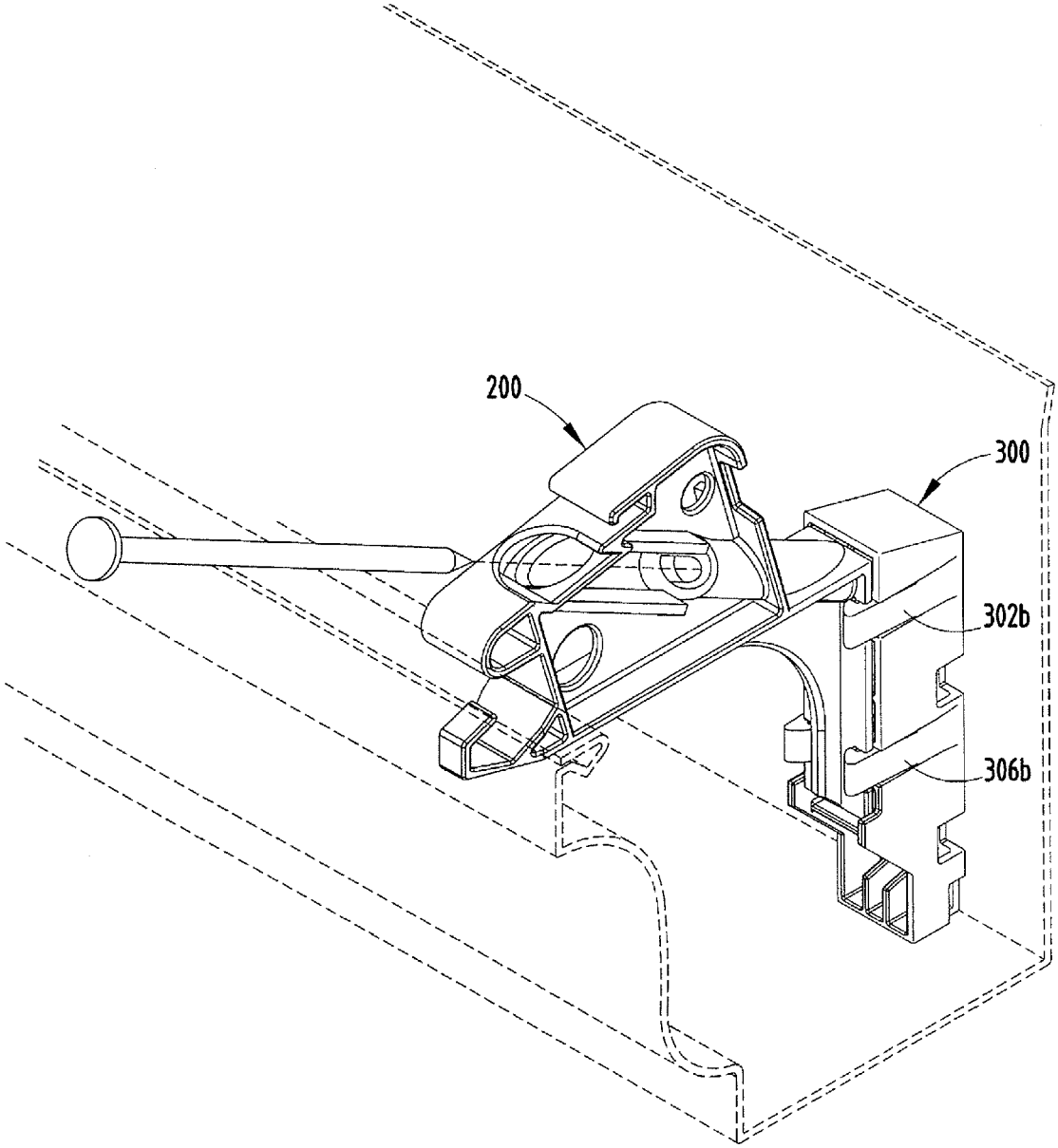
FIG. 23 illustrates a perspective view of the extension member shown in FIG. 18 coupled with the gutter bracket shown in FIG. 13.
Figure 24:
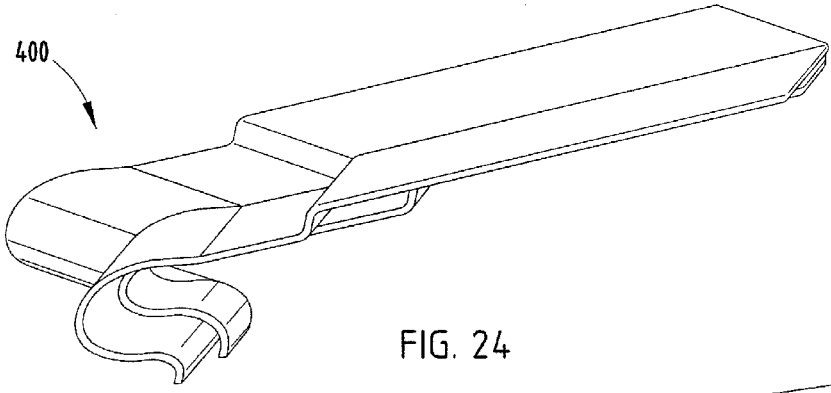
FIG. 24 illustrates a perspective view of an inside corner mullion.
Figure 25:
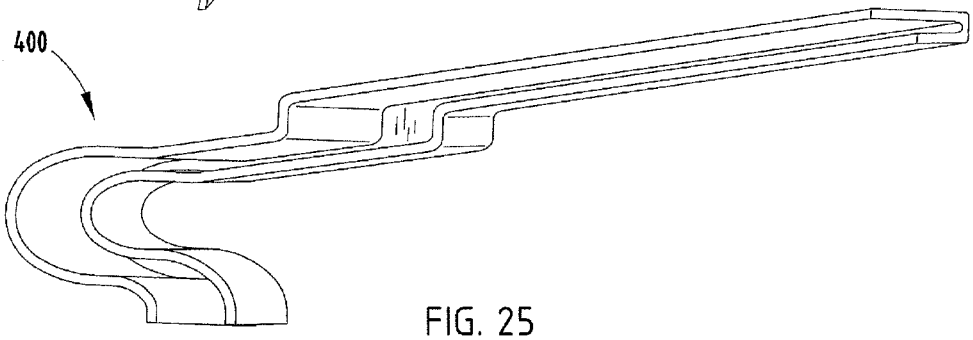
FIG. 25 illustrates a side view of the corner mullion shown in FIG. 24.
Figure 26:
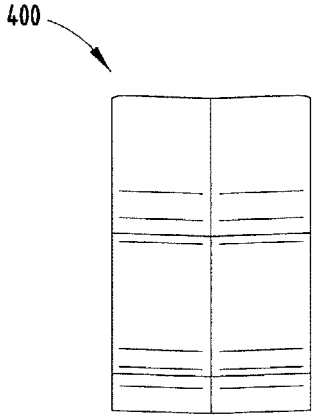
FIG. 26 illustrates a front view of the corner mullion shown in FIG. 24.
Figure 28:
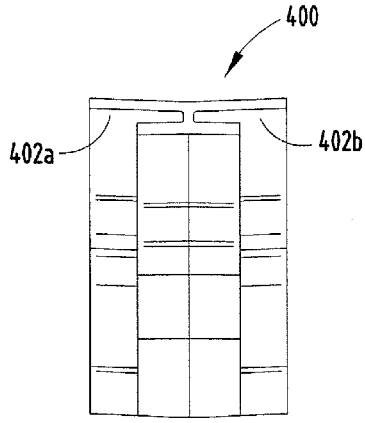
FIG. 28 illustrates a rear view of the corner mullion shown in FIG. 24.
Figure 27:
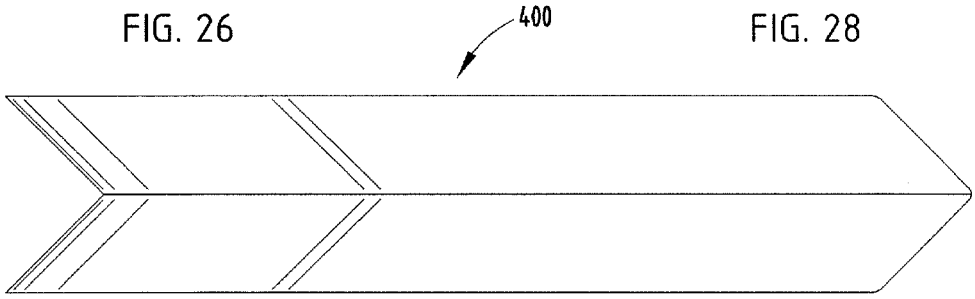
FIG. 27 illustrates a top view of the corner mullion shown in FIG. 24.
Figure 29:
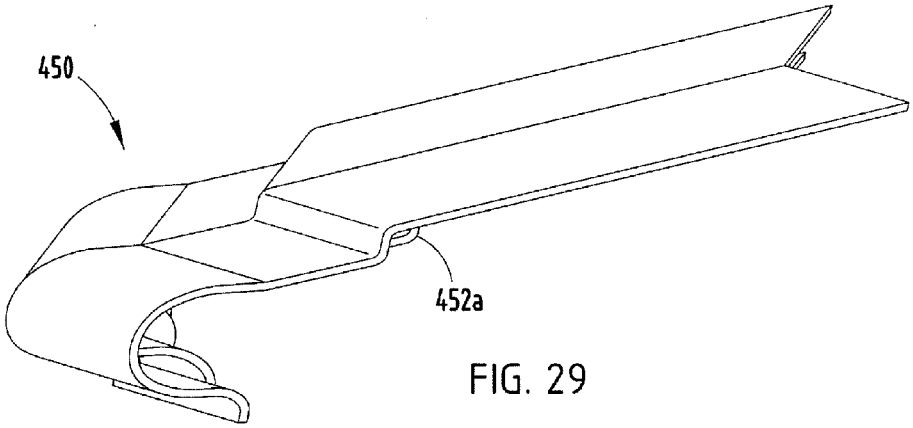
FIG. 29 illustrates a perspective view of an outside corner mullion.
Figure 30:
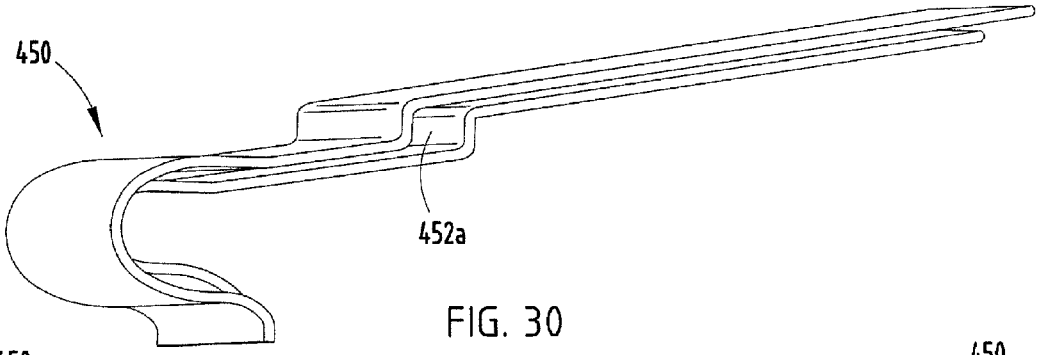
FIG. 30 illustrates a side view of the corner mullion shown in FIG. 29.
Figure 31:
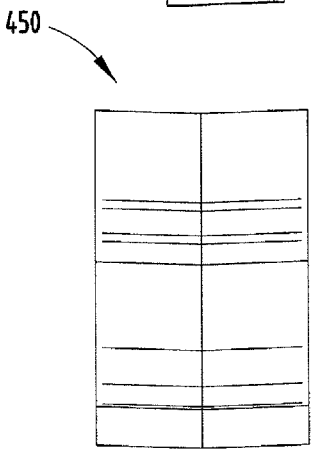
FIG. 31 illustrates a front view of the corner mullion shown in FIG. 29.
Figure 33:
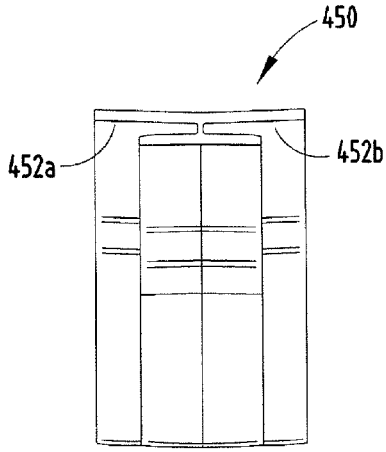
FIG. 33 illustrates a rear view of the corner mullion shown in FIG. 29.
Figure 32:
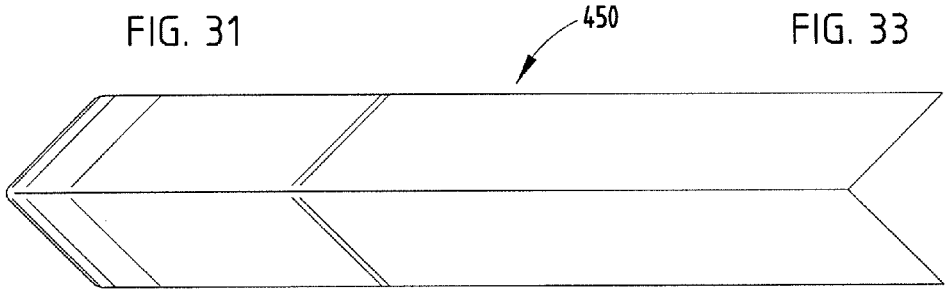
FIG. 32 illustrates a top view of the corner mullion shown in FIG. 29.
Figure 34:
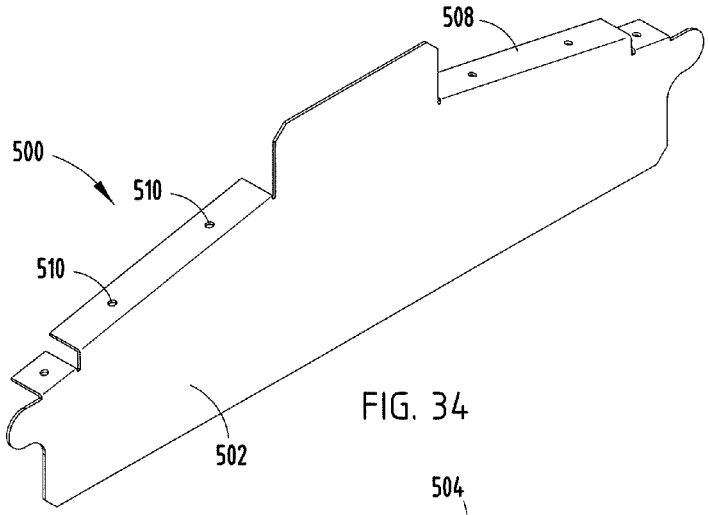
FIG. 34 illustrates a perspective view of a gutter end cap.
Figure 35:
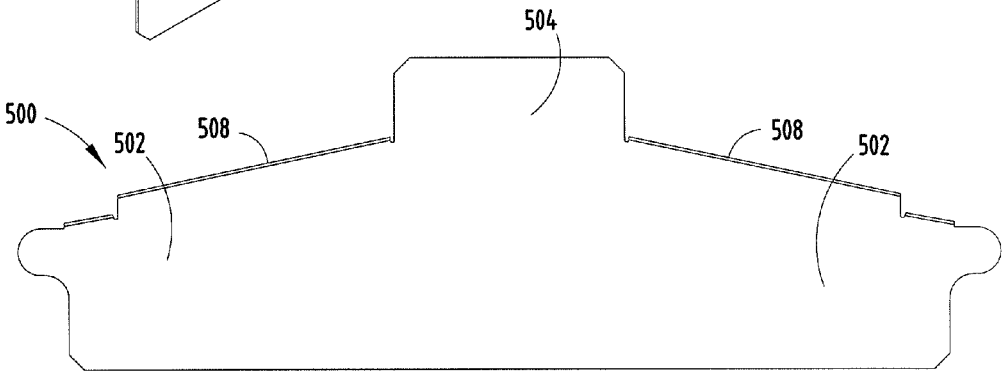
FIG. 35 illustrates a side view of the gutter end cap shown in FIG. 34.
Figure 36:
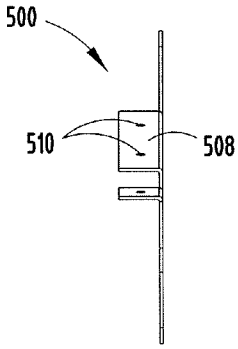
FIG. 36 illustrates a front view of the gutter end cap shown in FIG. 34.
Figure 38:
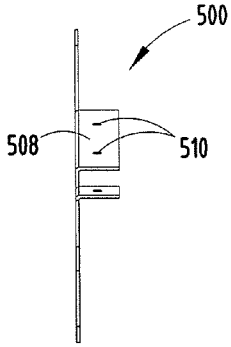
FIG. 38 illustrates a rear view of the gutter end cap shown in FIG. 34.
Figure 37:
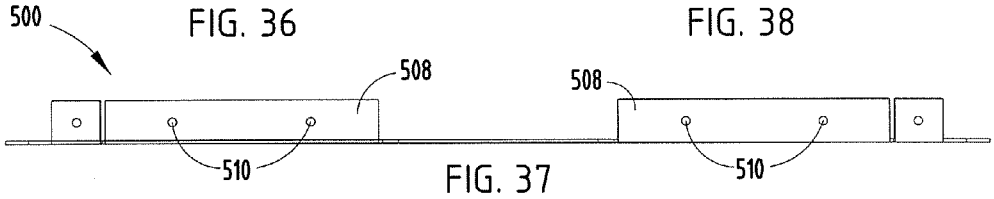
FIG. 37 illustrates a top view of the gutter end cap shown in FIG. 34.

Moreover, for attaching extension member 300 to bracket 200, extension member 300 may be removably connected to lower support member 220 by a snap fitting. For example, as shown in FIG. 17, the outer periphery of the lower support member 220 may include two sets of notch portions 222*a*, 222*b* and 224*a*, 224*b* located on opposed sides of lower support member 220 and on the upper and lower portions thereof. As shown in FIG. 18, extension member 300 may include corresponding snap fittings 302*a*, 302*b* and 306*a*, 306*b*, which each include a barbed portion 304*a*, 304*b* and 308*a*, 308*b* that acts to releasably secure extension member 300 to lower support member 220. It should be appreciated that the snap fittings 302*a*, 302*b* and 306*a*, 306*b* are flexible and therefore, capable of pushing outward in order to allow barbed portions 304*a*, 304*b* and 308*a*, 308*b* to move past the edge of notched portions 222*a*, 222*b* and 224*a*, 224*b*. Once the snap fittings 302*a*, 302*b* and 306*a*, 306*b* move past the barbed portions 304*a*, 304*b*, and 308*a* and 308*b*, the tension created by this flexing will force the snap fittings 302*a*, 302*b* and 306*a*, 306*b* back toward the lower support member 220 and secure the extension member 300 to the lower support member 220.

Extension member 300 may be formed by using standard injection molding techniques. While extension member 300 is preferably comprised of injection molded plastic, extension member 300 may also be made of other metals, vinyl materials, plastic or any other material which is light-weight, inexpensive and capable of acting as a rigid support member. Extension member 300 may also assume varying shapes and thicknesses depending on the environment with which it is being used without departing from the scope of this invention. For example, extension member 300 may be of a different size in order to allow bracket 200 to be extended by the desired length. Because the periphery of extension member 300 mirrors that of lower support member 220, it may even be possible to couple more than one extension member 300 to bracket 200, i.e., by coupling an extension member 300 to another extension member 300, as needed. It should also be appreciated that the geometry of the lower support member 220 may be altered so long as the extension member 300 is able to be removably attached thereto and that other means for removably attaching extension member 300 to bracket 200 may also be used.

It is common in the industry for structures such as structure 20 to form inside and outside corners, rather than have just straight lines. Gutters, such as gutter 30, must track these inside and outside corners. In order to allow the present invention to also track any inside and outside corners formed on structure 20, an inside corner mullion 400 and an outside corner mullion 450 may be provided. As shown in FIGS. 24 through 28 and FIGS. 29 through 33, each of these mullions 400, 450 are designed to join two abutting gutter covers 50, where the gutter covers are positioned at different angles with respect to one another. The corner mullions 400, 450 each mirror the geometry of the edge 50*a* of the respective gutter cover 50 and include a channel 402*a*, 402*b*, 452*a*, 452*b* for receiving the edge 50*a* of the respective gutter cover 50. While each of the corner mullions 400, 450 require edge 50*a* to be cut at a specific angle, it should be appreciated that the required angle may be varied by providing corner mullions 400, 450 with varying angles. Corner mullions 400, 450 may be formed by using standard injection molding techniques. While corner mullions 400, 450 are preferably comprised of injection molded plastic, corner mullions 400, 450 may also be made of other metals, vinyl materials, plastic or any other material which is light-weight, inexpensive and capable of acting as a rigid support member. Corner mullions 400, 450 may also assume varying shapes and thicknesses depending on the environment with which it is being used without departing from the scope of this invention.

For sealing the ends of both gutters 30 and gutter covers 50, an end cap 500 may be provided. This is accomplished by providing an end cap 500 that includes a gutter cap portion 502 and a gutter cover portion 504. As shown in FIGS. 34 through 38, to attach end cap 500 to gutters 30, the gutter cap portion 502 may also include a gutter cap fold 508. In addition, fold 508 may also include a plurality of holes 510 for receiving fasteners (not shown) for attaching gutter cap 500 to gutter 30. End cap 500 may be formed by using standard injection molding techniques and may be made of materials, such as plastic, metals, vinyl materials, plastic or any other material which is light-weight, inexpensive and capable of acting as a rigid support member. End cap 500 may also assume varying shapes and thicknesses depending on the environment with which it is being used without departing from the scope of this invention. Although FIGS. 34 through 38 show a pair of end caps 500, which are mirror images of each other and which form an integral unit, this unit may be cut into two end caps on-site or prior to distribution. It is preferred, however, that two end caps 500 be manufactured at a time.

While specific embodiments of the invention have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A rain gutter system for buildings, comprising:

a conventional rain gutter having a generally trough-shaped interior, a rear wall extending along a roof fascia, a bottom wall and a front lip; and a gutter cover assembly for deflecting debris from said interior of said gutter, including:

an elongate gutter cover having a back section extending along an associated roof, a middle section extending over said interior of said gutter, and a front section extending adjacent to said front lip of said gutter; said middle section of said gutter cover having an integrally formed, longitudinally extending fold that defines a female coupling member having a doubled over portion which projects at a predetermined angle toward said back section of said gutter cover, with a closed rearward end thereof positioned toward said back section of said gutter cover, and an opposite forward necked end thereof positioned toward said front section of said gutter cover and oriented vertically below said closed end along said predetermined angle, so that said doubled over portion of said female coupling member opens downwardly at said predetermined angle to prevent rainwater and debris from collecting therein; and a mounting bracket operably connected with said gutter and having an intermediate portion supporting said middle section of said gutter cover thereon to deflect debris from said interior of said gutter, and a forward portion supporting said front section of said gutter cover along said front lip of said gutter; said intermediate portion of said mounting bracket having a projection protruding toward said front section of said mounting bracket to define a male coupling member that extends forwardly and downwardly at said predetermined angle of said female coupling member, and is closely received and selectively retained in said female coupling member to securely mount said gutter cover on said mounting bracket without separate fasteners.

2. A rain gutter system as set forth in claim 1, wherein:

said female coupling member in said gutter cover is generally U-shaped with generally parallel, opposite walls vertically spaced apart and inclined at said predetermined angle.

3. A rain gutter system as set forth in claim 2, wherein:

said projection on said male coupling member is disposed vertically above said intermediate portion of said mounting bracket and oriented generally parallel therewith at said predetermined angle to define a downwardly opening slot into which said doubled over portion of said female coupling member is received.

4. A rain gutter system as set to forth in claim 3, wherein:

said male coupling member on said gutter cover is shaped for secure, yet detachable, reception in said female coupling member on said mounting bracket.

5. A rain gutter system as set forth in claim 4, including:

at least one gutter hanger supporting said gutter along the fascia of the associated roof, and including at least one generally vertically oriented mounting aperture therethrough; and wherein said mounting bracket includes at least one pin-shaped fastener received and retained in said mounting aperture of said gutter hanger to support said mounting bracket on said gutter hanger.

6. A rain gutter system as set forth in claim 5, wherein:

said pin-shaped fastener comprises a push-in fastener.

7. A rain gutter system as set forth in claim 6, wherein:

said front section of said gutter cover has an arcuately shaped lip section; and said forward portion of said mounting bracket has an arcuately shaped forwardmost area shaped similar to and abutting said lip section of said gutter cover.

8. A rain gutter system as set forth in claim 7, wherein:

said gutter cover includes at least one protrusion shaped to impede rainwater flow into said interior of said gutter.

9. A rain gutter system as set forth in claim 8, wherein:

said mounting bracket includes a center wall portion.

10. A rain gutter system as set forth in claim 9, wherein:

said mounting bracket has a one-piece, integrally formed, molded construction of synthetic resin material.

11. A cover assembly for conventional rain gutters of the type having a generally trough-shaped interior, a rear wall extending along a roof fascia, a bottom wall and a front lip, comprising:

an elongate gutter cover having a back section shaped to extend along an associated roof, a middle section shaped to extend over the interior of the gutter, and a front section shaped to extend adjacent to the front lip of the gutter; said middle section of said gutter cover having an integrally formed, longitudinally extending fold that defines a female coupling member having a doubled over portion which projects at a predetermined angle toward said back section of said gutter cover, with a closed rearward end thereof positioned toward said back section of said gutter cover, and an opposite forward necked end thereof positioned toward said front section of said gutter cover and oriented vertically below said closed end along said predetermined angle, so that said doubled over portion of said female coupling member opens downwardly at said predetermined angle to prevent rainwater and debris from collecting therein; and a mounting bracket shaped for operable connection with the gutter, and having an intermediate portion supporting said middle section of said gutter cover thereon to deflect debris from the interior of the gutter, and a forward portion shaped to support said front section of said gutter cover along the front lip of the gutter; said intermediate portion of said mounting bracket having a projection protruding toward said front section of said mounting bracket to define a male coupling member that extends forwardly and downwardly at said predetermined angle of said female coupling member, and is closely received and selectively retained in said female coupling member to securely mount said gutter cover on said mounting bracket without separate fasteners.

12. A cover assembly as set forth in claim 11, wherein:

said female coupling member in said gutter cover is generally U-shaped with generally parallel, opposite walls vertically spaced apart and inclined at said predetermined angle.

13. A cover assembly as set forth in claim 12, wherein:

said projection on said male coupling member is disposed vertically above said intermediate portion of said mounting bracket and oriented generally parallel therewith at said predetermined angle to define a downwardly opening slot into which said doubled over portion of said female coupling member is received.

14. A cover assembly as set forth in claim 13, wherein:

said male coupling member on said gutter cover is shaped for secure, yet detachable, reception in said female coupling member of said mounting bracket.

15. A cover assembly as set forth in claim 14, wherein:

said mounting bracket includes at least one pin-shaped fastener for close reception in a mounting aperture of an associated gutter hanger.

16. A cover assembly as set forth in claim 15, wherein:

said pin-shaped fastener comprises a push-in fastener.

17. A cover assembly as set forth in claim 16, wherein:

said front section of said gutter cover has an arcuately shaped lip section; and said forward portion of said mounting bracket has an arcuately shaped forwardmost area shaped similar to and abutting said lip section of said gutter cover.

18. A cover assembly as set forth in claim 17, wherein:

said gutter cover includes at least one protrusion shaped to impede rainwater flow into the interior of the gutter.

19. A cover assembly as set forth in claim 18, wherein:

said mounting bracket includes a center wall portion.

20. A cover assembly as set forth in claim 19, wherein:

said mounting bracket has a one-piece, integrally formed, molded construction of synthetic resin material.

* * * * *